United States Patent [19]

Bühler

[11] Patent Number: 4,724,888

[45] Date of Patent: Feb. 16, 1988

[54] METHOD AND APPARATUS FOR THE PRODUCTION OF FLASKLESS FOUNDRY MOLDS

[76] Inventor: Eugen Bühler, Schleifweg 3, 8877 Burtenbach, Fed. Rep. of Germany

[21] Appl. No.: 823,569

[22] Filed: Jan. 29, 1986

[30] Foreign Application Priority Data

Mar. 1, 1985 [DE] Fed. Rep. of Germany ..... 3507179

[51] Int. Cl.[4] ..... B22C 15/28

[52] U.S. Cl. ..... 164/7.1; 164/12; 164/29; 164/37; 164/38; 164/160.1; 164/169; 164/195

[58] Field of Search ..... 164/7.1, 160.1, 12, 164/29, 37, 38, 169, 195

[56] References Cited

U.S. PATENT DOCUMENTS 4,318,437 3/1982 Kemp ..... 164/7.2
4,586,555 5/1986 Buhler ..... 164/340 X
4,593,740 6/1986 Buhler ..... 164/44

FOREIGN PATENT DOCUMENTS 0122116 10/1984 European Pat. Off. ..... 164/20
2844464 4/1980 Fed. Rep. of Germany .

*Primary Examiner*—M. Jordan
*Assistant Examiner*—R. Batten
*Attorney, Agent, or Firm*—Jones, Tullar & Cooper

[57] ABSTRACT

A method and apparatus for producing flaskless foundry molds made up of copes and drags of wet casting foundry sand, which is blasted into a cavity to form the mold with the use of vacuum. The sand is pressed mechanically while aspirating air therefrom. The gap coming into existence between the pressing plate and the back side of a mold during pneumatic impact compaction is filled with sand before pressing so that a flat back side is produced on the mold so that when casting takes place later there is not danger of the bottom of the mold fracturing or of deformation taking place.

6 Claims, 1 Drawing Figure

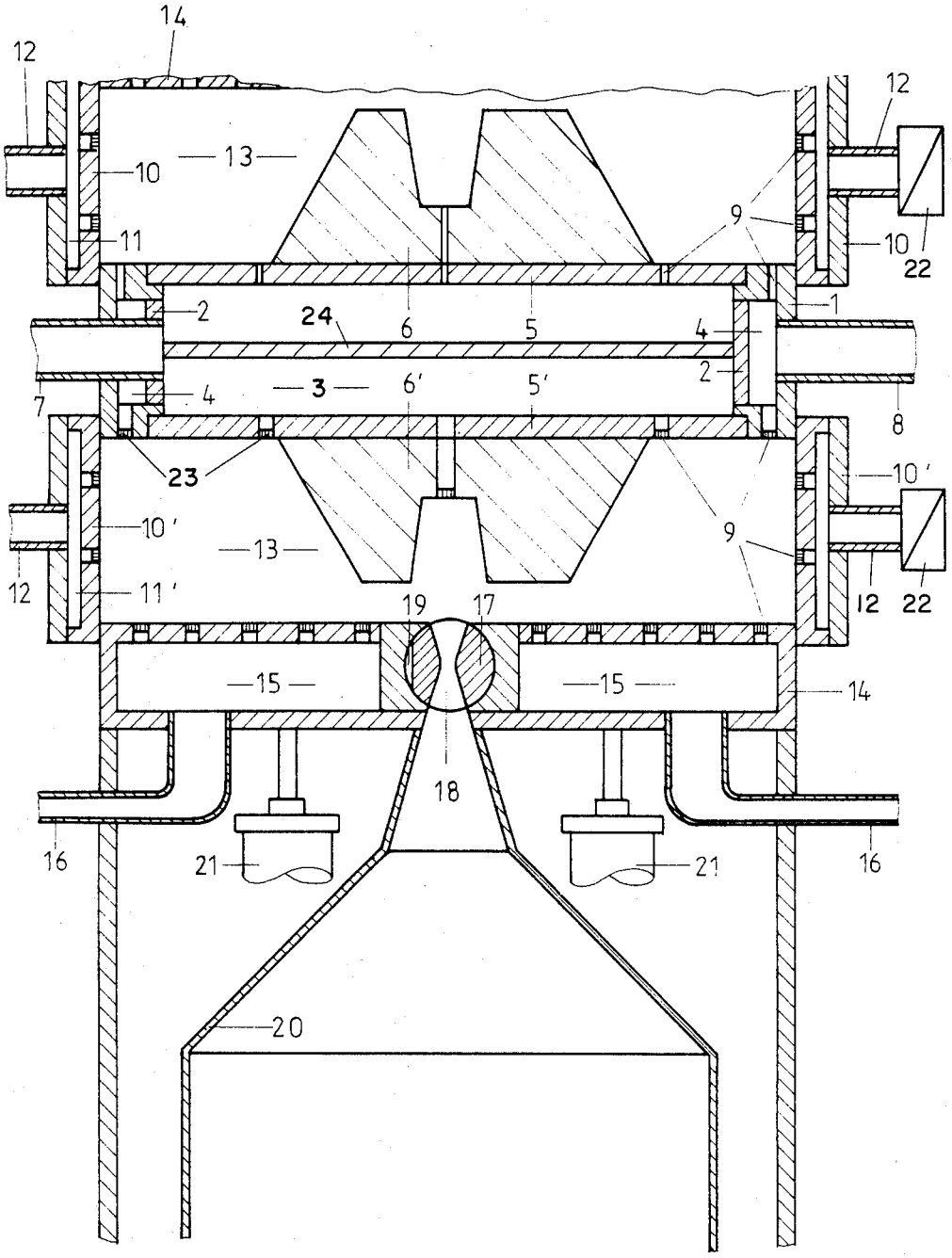
14
12
12
13
10
9
11
10
22
2
24
6
5
1
4
2
7
4
3
6'
5'
8
23
10'
10'
9
13
12
11'
12
22
19
17
15
15
14
18
16
21
21
16
20

METHOD AND APPARATUS FOR THE PRODUCTION OF FLASKLESS FOUNDRY MOLDS

BACKGROUND OF THE INVENTION

The present invention is concerned with improvements in foundry technology and more specifically relates to the production of foundry molds such as flaskless molds made up of two halves of wet casting foundry sand with tall mold bodies or closely placed mold ribs as for example for an electric motor housing provided with cooling ribs. In the production of such a mold the sand is firstly introduced by vacuum blasting into the mold making cavity, compacted by the pneumatic impact principle and then mechanically pressed while at the same time air is aspirated from the sand.

Such a method of mold production has been previously proposed in the German Pat. No. 2,844,464. Since however the machines proposed in this patent were only designed for producing mold halves with flasks, the rational use of such machines would only be possible with a pair of machines with mold transfer and mold assembly equipment for handling the mold halves produced by them.

The German Pat. No. 3,304,148 has proposed a method making possible the production of upper and lower mold halves in a single flaskless mold making machine having a mold producing device with the two halves of a pattern on its two respective sides. This mold making machine had a pattern plate carrier divided by vertical partitions into two chambers which were able to be separately subjected to vacuum or the action of compressed air. It was not however designed for compaction by pneumatic impact.

In compaction by pneumatic impact a sand-free space comes into existence between the shot blasting grating or the pressing platen (through which the compressed air is admitted) and the back side of the compacted mold.

In such a case the outline of the back of the mold generally matches the side of the mold adjacent to the pattern. For molds with flasks this is unimportant, because for the production of such molds a filling frame is used as a rule and after it has been removed the back side of the mold is strickled until it is at the same level as the edge of the flask.

In the case of flaskless molds the situation is different. A substantial profitability factor here is the possibility of adapting the level of the mold component individually to the respective level of the pattern by programmed level adjustment of the blasting head or heads on a vacuum mold making machine, with the result that there is a substantial saving in sand. However the thin cover of sand on the lowest parts of the pattern possible with such a method makes it necessary to have a highly planar form of the back side of the mold in order to ensure that the flaskless molds resting on pallets are not deformed or broken open. It is more especially in the case of mold parts without a lower opening that it is not always possible to produce such an accurately planar form with blasting and pressing gratings as so far in use.

SUMMARY OF THE PRESENT INVENTION

One object of the invention is to devise a method and apparatus with which foundry molds of the initially stated type may be produced while ensuring that the mold back side may be made with a highly planar or flat form at the least expense while at the same time guaranteeing the required degree of mold strength.

In order to achieve this and other objects as well become apparent during the course of the following specification, the sand is blasted into the mold cavity through an opened valve means in a hollow pressing platen and is pneumatically compacted, whereafter the cavity then produced during pneumatic impact compaction between the pressing platen and the back side of the mold is filled by a second vacuum blasting shot with sand and the sand in it is then pressed.

In accordance with a preferred feature of the invention the compressed air employed for pneumatic impact compaction is admitted through air inlet orifices evenly distributed over a large area of the pressing platen towards the mold back side and is vented through air orifices in the pattern plate near to the pattern and pattern space. The compressed air used for pneumatic impact compaction may be admitted through openings provided in the mold frame, towards the side walls of the mold.

As a further development of the method adapted for simultaneously producing upper and lower mold halves, the foundry sand is blasted into the upper mold cavity by a lower degree of vacuum than in the lower mold cavity.

In accordance with the invention the apparatus for use in the method may consist of a vacuum mold blasting machine with at least one mold frame and a hollow pattern plate carrier divided by vertical partitions into two independent pressure and vacuum chambers characterized by the use of at least one hollow pressing platen having a plurality of air inlet orifices covered with sand filters on its mold cavity side and a blast inlet valve with a slot-like opening.

In accordance with further preferred features of the invention the inlet blast valve comprises a rotary roller-like valve member in the pressing platen. The valve member may have a flat running along its length so as to be coplanar with the pressing face of the platen when the valve is shut. The mold frame may be made with double walls and the cavity or interior space therein may have a connection with a means for putting it under vacuum or under pressure under the control of a valve and it may have air inlet orifices in its wall.

In accordance with a further preferred feature of the invention the hollow pattern plate carrier is divided up by one or more horizontal partitions into chambers of which the chamber or chamber functionally connected with the upper pattern plate may be subjected to a different pressure than the chamber or chambers associated with the lower pattern plate.

Since the hardness of the mold on the surface of the pattern as produced by the pneumatic impact compaction depends to a certain extent on the direction of flow of the blast of compressed air onto it the features of the invention noted with special design of pressing platens and mold frames chiefly serve to control the pressure at the lower and sides produced during the compaction operation. The systematic control of the direction of flow makes possible a sufficient compaction even in the case of tall patterns such as electric motor housings placed on end including the spaces between the ribs of such patterns, Furthermore signs of penetration and deformation of the mold otherwise occurring during casting into the mold may be avoided.

On filling the upper mold cavity the blasting operation is aided by the force of gravity acting on the sand. The blasting operation therefore in this case makes possible the use of a lower pressure differential in the upper mold cavity as has been noted. This may be made possible by having a smaller overall cross section of the air orifices between the suction space and the upper mold cavity than is the case for the lower mold cavity (see the figure hereto, later to be described).

This effect may also be produced by division into one or more chambers as noted above in the pattern plate carrier or by the use of two pattern plate carriers with air-tight back sides placed against each other.

BRIEF DESCRIPTION OF THE DRAWING

The single drawing FIGURE shows the inventive vacuum mold making apparatus for producing flaskless molds.

DETAILED DESCRIPTION OF THE PREFERRED EMBODIMENT

One embodiment of the invention will be seen in the figure which shows the mold part in the more limited sense of the word in the particular case of the lower mold half of a vacuum mold making machine working on the initially noted principle. The middle part of the mold part is in the form of a hollow pattern plate carrier 1, which is divided by vertical partitions 2 into a central air chamber 3 and an outer air chamber 4 surrounding same peripherally. The upper and lower wall of the central air chamber 3 form an upper and a lower pattern plate 5 and 5', which have the respective pattern halves 6 and 6' mounted thereon. It is possible for the air chambers to be connected via their separate air ducts 7 and 8 and via a valve system 22 both jointly and severally with means for putting them under vacuum and under pressure using compressed air. This system furthermore makes it possible for the chambers to be put under different pressures. By way of air slots 9, that are covered by, cast in, or inserted filter nozzles or pieces of filter foil 23 to prevent the passage of sand, each of the chambers is furthermore connected with the interior of upper and lower mold frame 10 and 10'. This interior space is walled in on the side that is respectively opposite the pattern plate by means of a hollow pressing platen 14 and constitutes the mold space 13 properly so called. In the case illustrated the mold frames 10 and 10' are made with double walls so as to define air chambers 11 and 11' that is connected via air orifices 9 with the mold cavity 13 and are furthermore connected with the valve control system via air ducts 12. Furthermore the interior space of the hollow pressing platen constitutes an air chamber 15 that is connected via air ducts 16 with the valve system and is joined with the mold cavity via air orifices 9.

In the pressing platen 14 there is a valve that comprises a roller-like valve member 17, preferably placed in the middle of the platen, for turning about a horizontal axis. It has a diametral slot 18 stretching along its length. In the position shown this slot connects the mold cavity 13 with the elongated funnel-like part of a sand hopper 20 and makes it possible for the sand to be blasted in for nearly the full length of the mold cavity 13. The other face of the valve member 17 has a flat 19 such that when the valve member is in the shut position it is coplanar with the rest of the pressing face of the platen 14. The pressing platen 14 and the sand hopper 20 are able to be moved vertically by means of actuators 21 that are only shown in part. Furthermore the valve with the valve member 17 is opened and shut by such an actuator by turning it through 90°.

For the production of a mold the vacuum mold making machine is set in the position shown in the figure. By the sudden aspiration of air from the mold cavity 13 through the chamber 3 of plate carrier 1 and or platens 14 and/or frames 10 and 10' under the control of the valve system operating, in accordance with a program, which chamber or chambers being used taking into account the form of the patterns, the mold cavities 13 are caused to be filled with sand through slot 18. Then the valve member 17 is turned into the shut position and with the pressing plate which is unmoved when air is blasted into the cavaity, is clear of the sand air is blasted into the mold cavity, again in accordance with the geometry of the pattern. Such air is then discharged, most conveniently via the central air chamber 3 in the pattern plate carrier and/or the cavity 11. When this happens the sand in the mold cavity is compacted and a sand-free gap comes into being between the hard back side of the mold and the pressing platen. This space is then filled up with sand, after opening the valve member 17, by putting the space under vacuum for the second time. When this takes place air is drawn off abruptly through the pressing platen and possibly the mold frames. This subsequently admitted sand may now be compacted by mechanical pressing with the valve member 17 shut to form a flat back side to the mold. During the pressing operation the air may simultaneously be drawn off from the compacted foundry sand so that there is no resilient distortion of the mold when casting takes place and no fumes are evolved during casting. The mold halves are lowered in a known manner, possibly with the supporting action of compressed air, and placed together so that the mold ready for casting may be placed on a pallet.

In the working example of the invention illustrated, the air chambers 3 and 4 of the pattern plate carrier are not subdivided in the horizontal direction. In this case the mold cavity 13 under and over the pattern plate carrier 1 is put under the same degree of pressure of the vacuum. In many cases it may be expedient to use different degrees of pressure and vacuum over and under the carrier 1. In such a case the air chambers 3 and 4 of the pattern plate carrier 1 may be subdivided by a horizontal partition 24 into superposed chambers.

I claim:

1. A method for the production of foundry molds from wet casting foundry sand and a vacuum molding machine including at least one mold frame and one hollow pattern plate carrier each with a plurality of air passageway openings, the mold frame and pattern plate carrier defining a mold cavity within which a mold pattern is situated, the mold cavity having a closable injection opening, the method comprising the steps of:

evacuating the mold cavity and thereby drawing a quantity of sand into the mold cavity through the injection opening;

closing the injection opening such that the interior surface of the mold cavity at the injection opening comprises an uninterrupted smooth surface;

introducing compressed air into the mold cavity through the plurality of air passageway openings and simultaneously removing air by suction from the mold cavity, thereby compacting the sand in the mold cavity;

opening the injection opening and evacuating the mold cavity again thereby drawing a further quantity of sand into the mold cavity between the compacted and previously drawn quantity of sand and the uninterrupted smooth surface of the mold cavity; and closing the injection opening again, followed by mechanical compression of the sand in the mold cavity and simultaneous removal of air by suction from the mold cavity.

2. The method as claimed in claim 1, wherein two mold frames and two hollow pattern plate carriers each with a plurality of air passageway openings and a closable injection opening are provided, each mold frame and pattern plate carrier defining a mold cavity within which a mold pattern is situated, and wherein the steps recited are carried out in association with each mold cavity, simultaneously.

3. The method as claimed in claim 2, wherien the degree to which the two mold cavities are evacuated varies.

4. An apparatus for the production of foundry molds from wet casting foundry sand, comprising:

at least one mold frame;

at least one hollow pattern plate carrier;

at least one hollow pressing platen, each pattern plate carrier and pressing platen having a wall associated with a wall of a mold frame to define thereby a mold cavity;

a mold pattern situated within the mold cavity; and a roller rotatably supported to each pressing platen, wherein:

each mold cavity defining wall includes a plurality of passageway openings opening into its associated mold cavity, and a sand filter associated with each passageway opening;

said roller defining an opening leading through the mold cavity defining wall of its associated pressing platen into the mold cavity associated with the pressing platen, and a flattened portion which comprises part of a smooth, uninterrupted surface with one surface of the mold cavity defining wall of its associated pressing platen when the roller opening is located so tha it does not lead into its associated mold cavity; and the smooth, uninterrupted surface serves as a pressing surface of the mold cavity.

5. The apparatus as claimed in claim 4, wherein the mold cavity defining wall of said mold frame comprises a double wall and said apparatus further comprises a valve control system for producing vacuum or pressure in said double wall selectively, said double wall including the plurality of passageway openings in communication with the mold cavity.

6. The apparatus as claimed in claim 4, further comprising at least one horizontal partition dividing a cavity in said pattern plate carrier into two chambers, and means for subjecting the two chambers to a different pressure.

* * * * *